United States Patent [19]

Becker

[11] 4,191,496

[45] Mar. 4, 1980

[54] GAS-BAG SUPPORTED STRUCTURAL FOUNDATION

[76] Inventor: Robert F. Becker, 777 NW. Carkeek Park Rd., Seattle, Wash. 98177

[21] Appl. No.: 859,172

[22] Filed: Dec. 9, 1977

Related U.S. Application Data

[63] Continuation-in-part of Ser. No. 756,844, Jan. 5, 1977, abandoned.

[51] Int. Cl.[2] ..... E02D 27/32; E02D 35/00

[52] U.S. Cl. ..... 405/229; 52/1; 52/126; 248/550; 405/130

[58] Field of Search ..... 61/50, 51; 52/126, 146, 52/167, 299, 2, 169.11; 248/550, 631; 405/229, 130

[56] References Cited

U.S. PATENT DOCUMENTS

| | | | |
|---|---|---|---|
| 837,618 | 12/1906 | Fixler et al. | 52/146 |
| 2,706,607 | 4/1955 | Withers et al. | 248/550 |
| 3,040,411 | 6/1962 | Messenger | 52/126 X |
| 3,281,101 | 10/1966 | May | 248/550 |
| 3,345,824 | 10/1967 | Turzillo | 61/50 X |
| 3,852,970 | 12/1974 | Cassidy | 61/51 |
| 4,074,474 | 2/1978 | Cristy | 52/2 |

FOREIGN PATENT DOCUMENTS

| | | | |
|---|---|---|---|
| 915353 | 11/1972 | Canada | 52/167 |
| 6708513 | 12/1968 | Netherlands | 52/126 |
| 397599 | 1/1974 | U.S.S.R. | 52/167 |

*Primary Examiner*—David H. Corbin
*Attorney, Agent, or Firm*—Eugene D. Farley

[57] ABSTRACT

A gas-bag supported structural foundation comprises at least one flexible, substantially air-tight bag adapted to be placed on the ground; a floor structure superimposed on the bag; a source of gas under pressure; conduits connecting the source of gas under pressure to the bag, and the bags to atmosphere; and in the conduits valve means responsive to changes in floor level and operative to direct the flow of gas to and from the bag as required to maintain the floor in a substantially level condition.

8 Claims, 22 Drawing Figures

GAS-BAG SUPPORTED STRUCTURAL FOUNDATION

This patent application is a continuation-in-part of the patent application of Robert F. Becker Ser. No. 756,844 filed Jan. 5, 1977, now abandoned, for AIR SUPPORTED BUILDING FOUNDATION.

BACKGROUND AND GENERAL STATEMENT OF THE INVENTION

This invention relates to structural foundations. It pertains particularly to gas supported building foundations and oil pipe line supports of use particularly in the Arctic where permafrost conditions prevail.

In permafrost areas the erection of buildings is made difficult because of the prevailing permafrost condition of the tundra underlying the building. As the permafrost freezes and thaws with changes in atmospheric conditions, the frozen tundra heaves, sinks and buckles. As a consequence, it is impossible to employ ordinary methods of building construction, as by erecting the building on poured concrete foundation walls, or on a poured concrete floor pad.

To overcome this problem it has been proposed to erect buildings on piling. Here again the permafrost condition of the tundra presents problems of the first magnitude.

The permafrost is hard, so that piling cannot be driven satisfactorily into it. Placing piling in the permafrost disturbs the natural tundra insulation and creates abnormal thawing conditions. As a consequence, the tundra at times melts and forms puddles of mud, which tend not to re-freeze promptly with the result that the piling is not supported adequately.

To overcome this difficulty it has been proposed to install the piling by drilling 15 to 20 feet into the permafrost, installing the piling, placing refrigeration coils about the piling, and freezing the piling in position. Under certain conditions, the piling must be permanently refrigerated to keep them in place.

Accordingly it is apparent that the erection of a piling-supported building in a permafrost area is an exceedingly costly and impractical procedure, the cost under current conditions averaging upwardly of $1,000 per pile plus two months labor charges. Such costs make the installation of piling-supported buildings prohibitive, except in special situations.

It also has been proposed, (Brown et al U.S. Pat. No. 3,734,138) to erect oil pipe lines in permafrost country on pneumatic bag supports whch conform to the original contour of the terrain. However, the proposed supports do not adjust with time to changes in ground level and condition and are not suitable for use in the erection and use of permanent buildings in the Arctic.

It is the general purpose of the present invention to provide structural foundations for use particularly beneath buildings located in permafrost areas, which can be erected at a small fraction of the cost of piling-supported foundations, and which will support the buildings satisfactorily over a long service life under the severe conditions of climate and topographical changes which prevail in the Arctic.

It is another purpose of the present invention to provide a building foundation for use in supporting floor structure which is responsive to varying loads carried by such structures.

Still another object of the present invention is the provision of a building foundation which affords protection from flooding.

Still a further object of the present invention is the provision of a structural foundation which in addition to being low in cost may be installed easily, rapidly and by labor possessing only the usual skills.

A further object of the present invention is the provision of a structural foundation which may be placed on any type of terrain, whether it be soft, boggy, sandy, unstable, or frozen, and which after erection will not rust, rot, nor sustain damage from termites.

The foregoing and other objects of this invention are accomplished by means of a gas-bag supported structural foundation which, generally stated, comprises at least one flexible bag adapted to be arranged on the ground and to support a predetermined structural load; a floor structure superimposed on the bag; and a source of gas under pressure. A conduit system connects the source of pressurized gas to the bags, and the bags to atmosphere. In the conduit system is placed valve means responsive to changes in floor level and operative to direct the flow of gas to and from the bag as required to maintain the floor in a substantially level condition.

In the preferred form of the invention, there are employed a plurality of bags manifolded together in groups in a pattern predetermined to support variable loads to be applied to the floor. In this manner the greatest number or density of bags may be supplied in areas expected to support the greatest load.

DESCRIPTION OF A PREFERRED EMBODIMENT OF THE INVENTION

Figure 17:
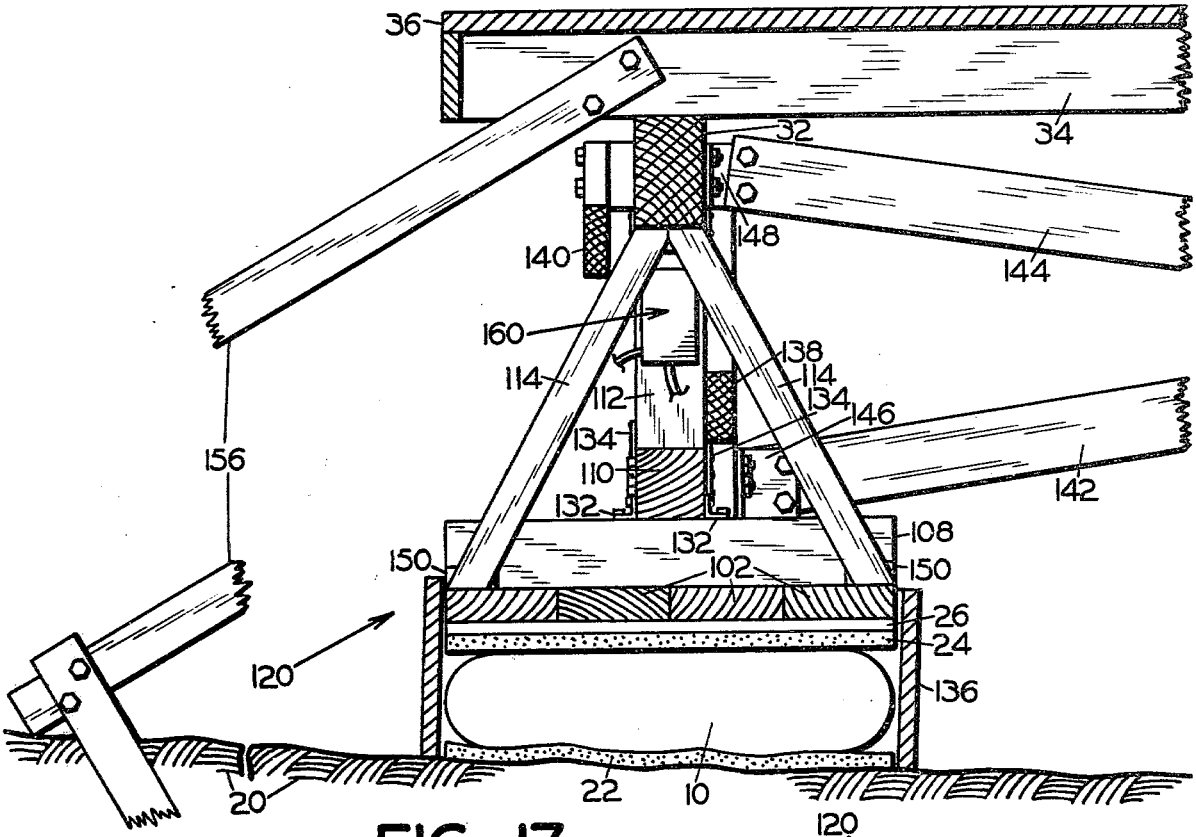
Figure 22:
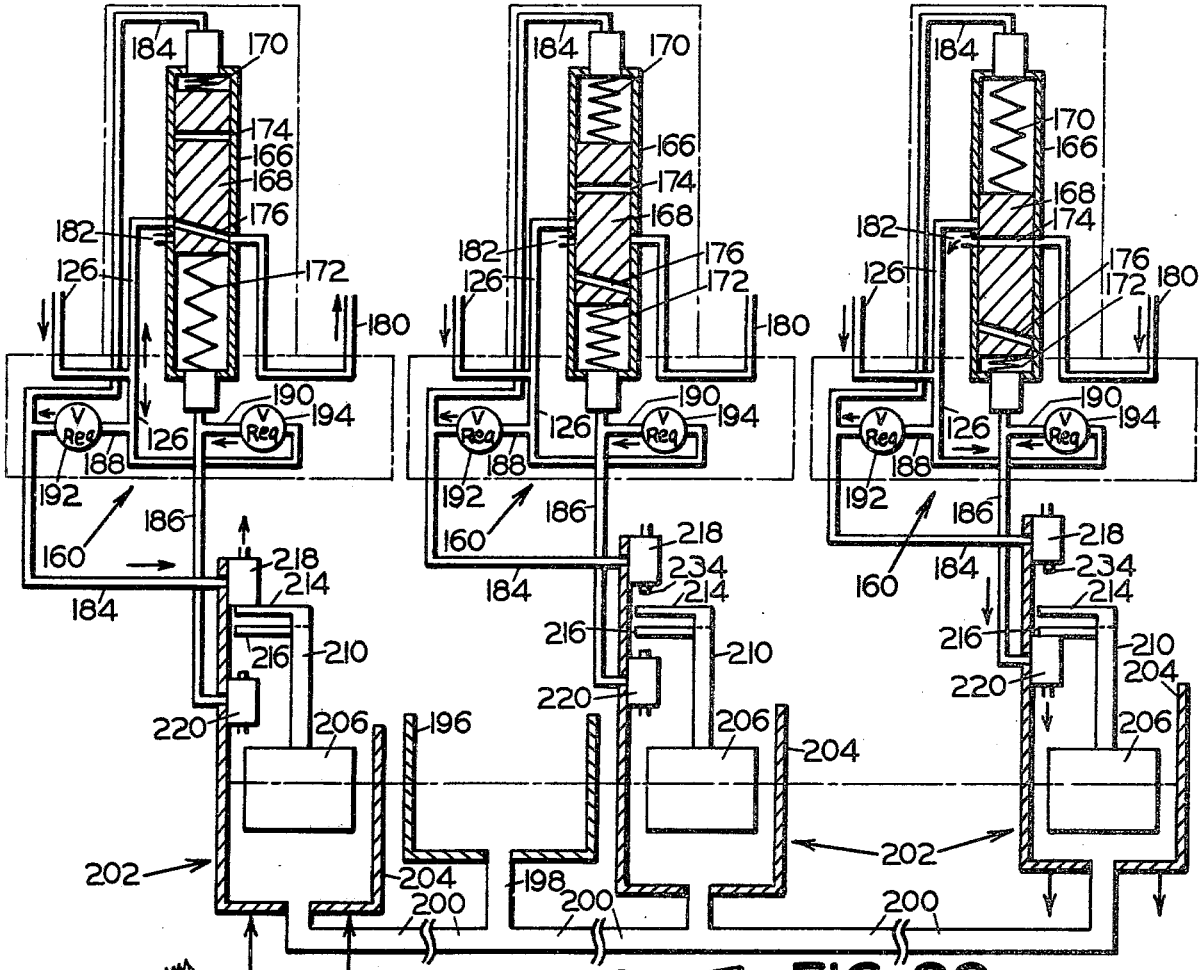
Figure 15:
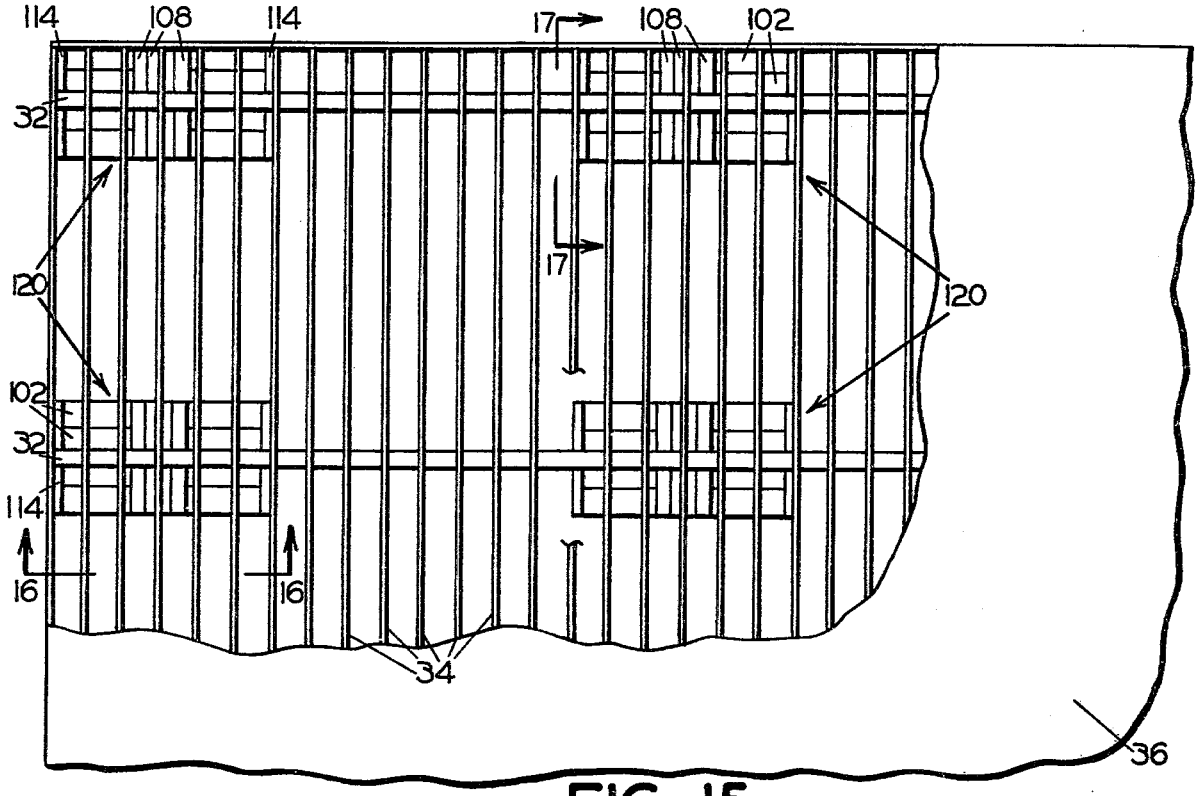
FIG. 15 is a fragmentary plan view of a floor laid on the foundation of FIG. 14, with the floor covering in part removed to show the foundation arrangement.
Figure 16:
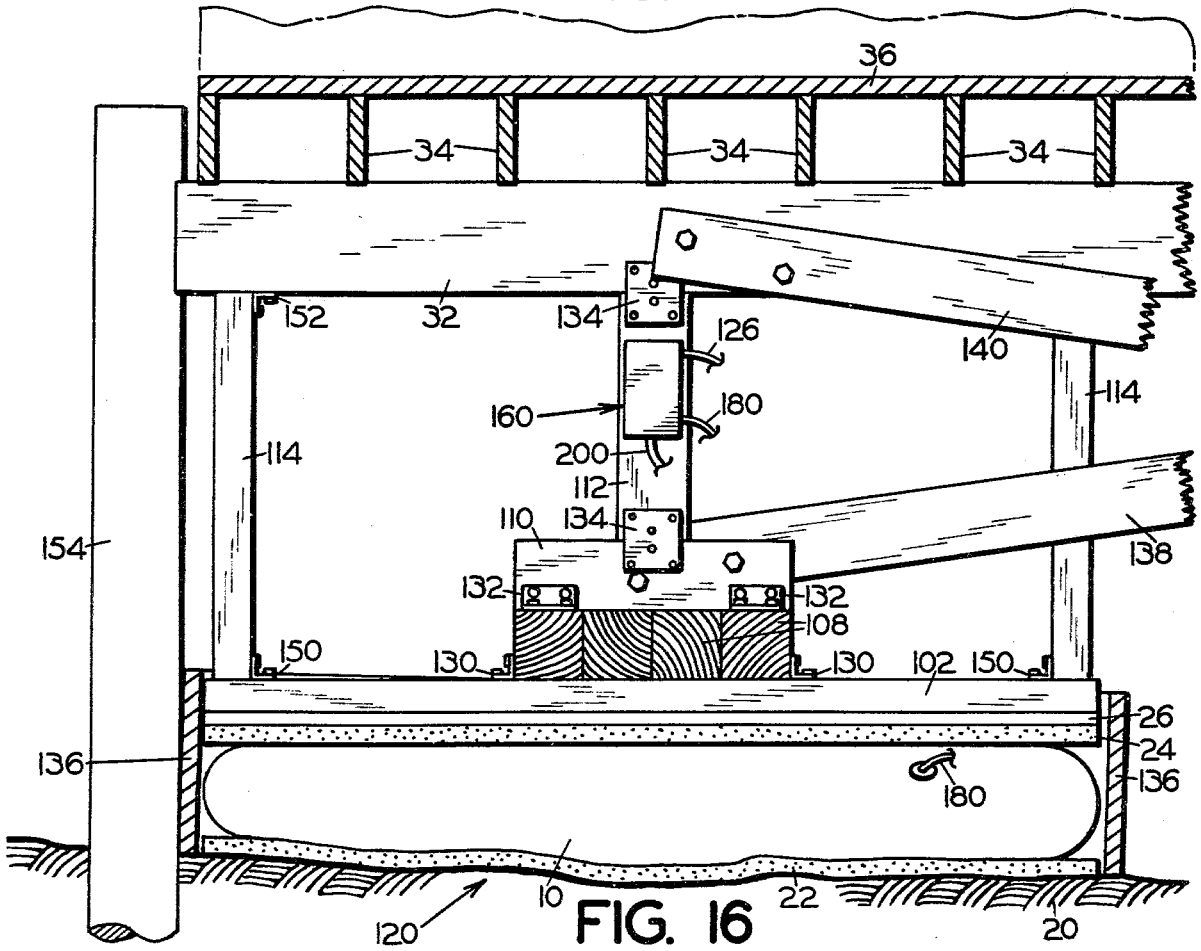
Figure 18:
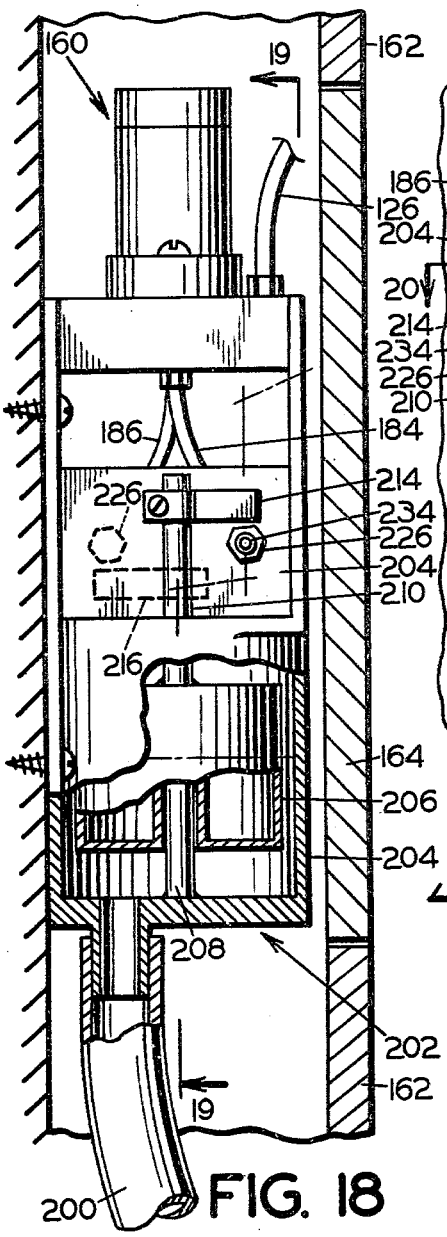
Figure 19:
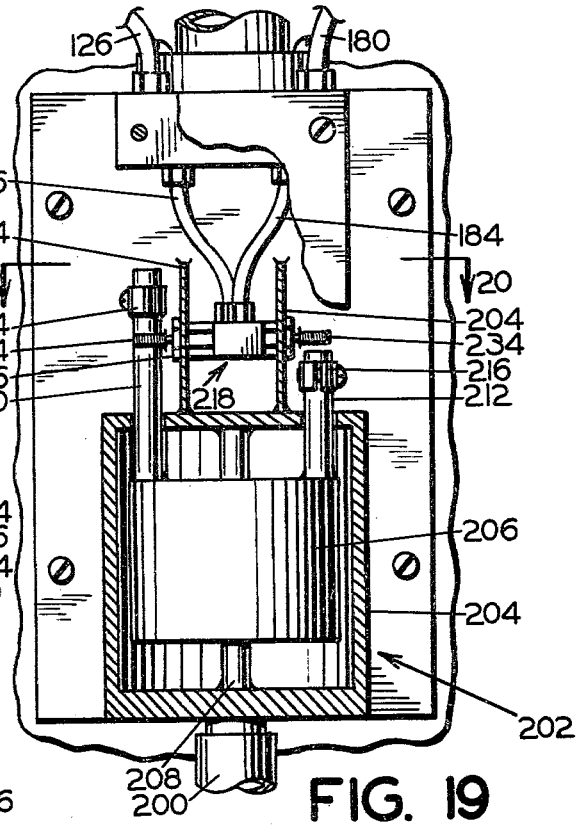
Figure 20:
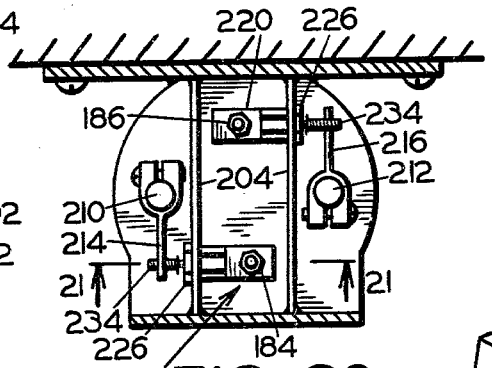
Figure 21:
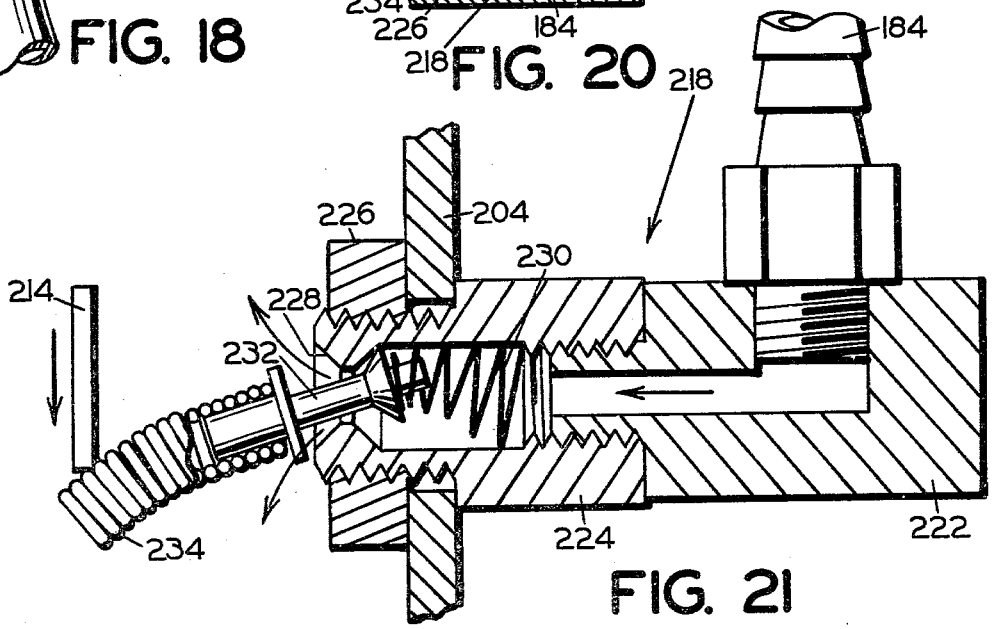

FIGS. 16 and 17 are fragmentary sectional views taken along line 16—16 and 17—17, respectively, of FIG. 15;

FIG. 18 is a view in side elevation, partly in section, of a pneumatic control for use in conjunction with the gas-supported structural foundation of my invention;

FIG. 19 is a sectional view taken along line 19—19 of FIG. 18;

FIG. 20 is a transverse sectional view taken along line 20—20 of FIG. 19;

FIG. 21 is an enlarged detail view in longitudinal section of a pneumatic exhaust valve used in the control unit of FIGS. 18–20;

FIG. 22 is a diagram of a pneumatic circuit including the controls of FIGS. 18–21 as applied to the operation of pneumatic valves used in the levelling of the hereindescribed foundation.

The key to the present invention is the concept of employing flexible gas bags filled with air, nitrogen, or other inert gas, for the purpose of supporting a structural foundation. The bags may be placed on the ground, underlying and supporting the strucure, thereby eliminating the necessity of pouring concrete walls or a concrete pad, or of driving supporting piling.

Such bags are available as the dunnage bags of commerce used to pack freight in trucks and railroad cars.

Dunnage bars are flexible; air-tight; made from strong, fabric-reinforced rubber sheets; and will support heavy loads. For example, a conventional commercial dunnage bag measuring 4'×8' will support a load of over 15 tons at pressures below ten lbs. per sq. in. Their strength accordingly is ample for erecting buildings of certain classes in the Artic where the frozen tundra itself will support only a limited load.

The construction of the flexible gas bags which are used in the execution of the present invention is illustrated in FIGS. 8–11 inclusive.

Each bag 10 is of a predetermined size, depending upon availability and the load to be supported. Bags having the conventional dunnage bag size of 4×8 feet are adequate for the present purpose, particularly when used in groups, as will appear hereinafter.

Each bag is provided with an air inlet 12 and an air outlet 14.

Each bag is made of heavy natural or synthetic rubber reinforced with fabric, preferably with Nylon threads. A protective cloth or plastic skin 16 may be bonded externally to the rubber.

The joints of the bag are tightly sealed.

Figure 10:
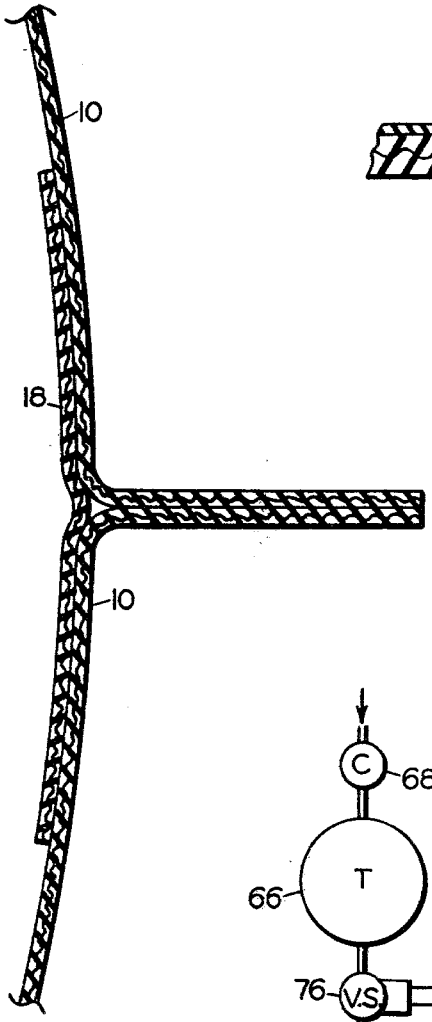
FIGS. 10 and 11 are fragmentary, detail, sectional views further illustrating the construction of the pneumatic bag of FIG. 8.
Figure 11:
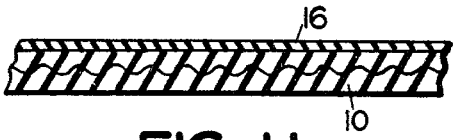

In one class of joint, illustrated in FIG. 10, the lapped margins of the rubber are glued together and the joint reinforced by an adhesively-united reinforcing strip 18.

Figure 9:
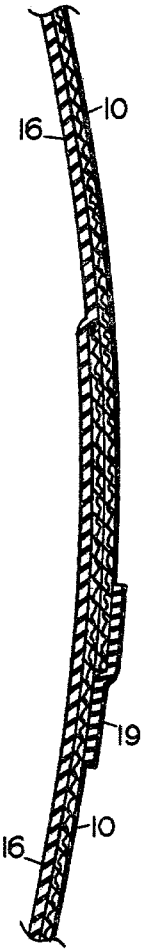
FIG. 9 is a fragmentary, transverse sectional view taken along line 9—9 of FIG. 8.

In another form of joint, illustrated in FIG. 9, the margins to be joined are lapped, glued together, and reinforced by a reinforcing strip 19*a*.

There thus is readily available at acceptable cost and in commercial quantities the large, strong, gas bags useful for the purpose of my invention.

Figure 3:
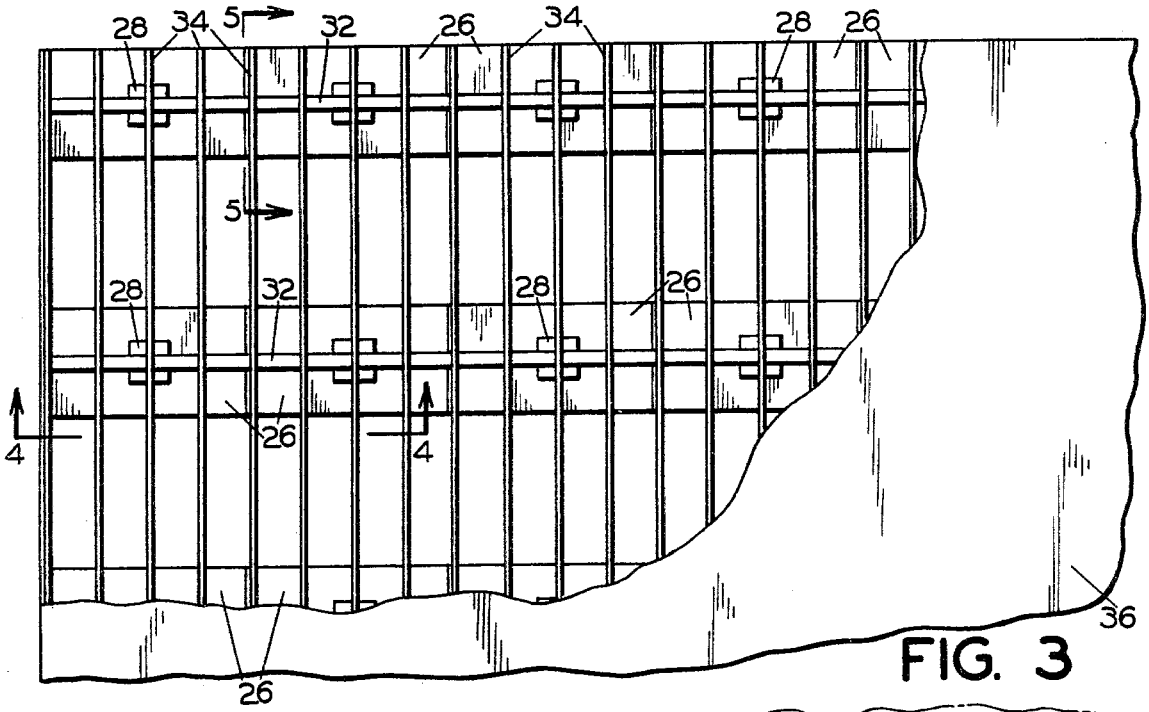
FIG. 3 is a fragmentary plan view of a floor laid on the foundation.
Figure 4:
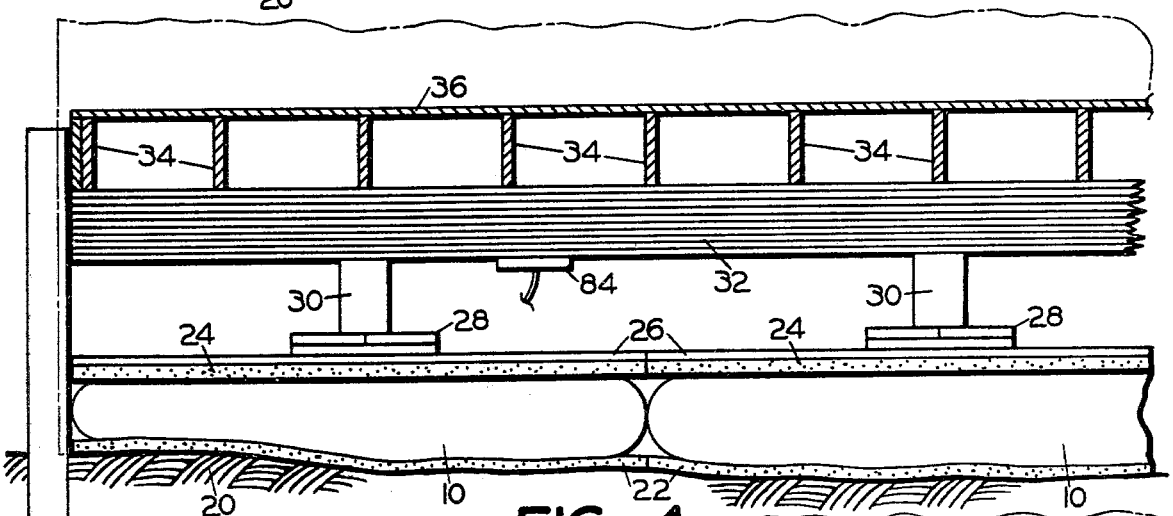
FIG. 4 is a fragmentary sectional view taken along line 4—4 of FIG. 3.
Figure 5:
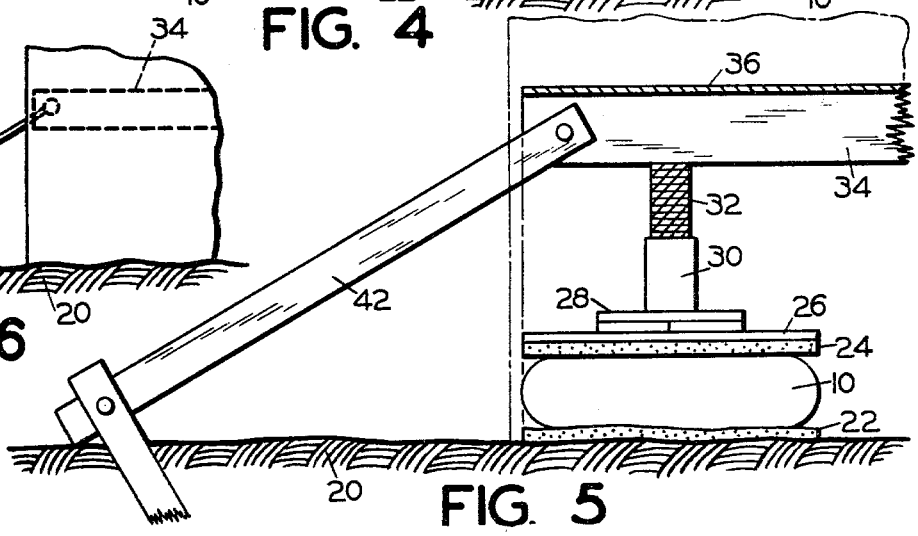
FIG. 5 is a fragmentary sectional view taken along line 5—5 of FIG. 3 and illustrating a lateral support for the building in a first embodiment.

The application of the gas bags to foundation assemblies of which they are components is illustrated particularly in FIGS. 3, 4 and 5.

The foundation is erected on ground 20, for example, permafrost terrain, the surface of which has been roughly leveled. If gravel is available it is preferred to cover the surface of the ground with about one foot of gravel.

The gravel pads thus provided then are overlaid with insulation boards 22. These may be sheets of conventional insulation board or cellulosic soft board in commercially available sizes, for example, in sizes of 4×8 feet. They serve the dual purposes of providing thermal insulation and also of protecting the bags from abrasion.

Bags 10 are superimposed on the insulation boards.

Upper insulation boards 24 are superimposed on the bags. They serve an insulating function. Also, since they present a soft, porous surface, they help prevent abrasion of the bags.

Plywood sheets 26 are superimposed on insulation boards 24. They are employed in the form of the plywood of commerce in sheets measuring, for example, 4×8 feet, and having a thickness of about $\frac{5}{8}$ inch. They serve as pads which protect the underlying components of the assembly and distribute the load.

Next in vertical order are post support pads 28. These may comprise plywood or lumber blocks of a dimension suitable to underlie the posts. In the illustrated form of the invention they are composited from an upper wooden component nailed to an underlying plywood component.

Pads 28 support posts 30 which comprise pieces of lumber measuring, for example, 6×6 inches. They serve to space the underlying foundation elements from the overlying foundation elements for purposes of ventilation.

Posts 30 support stringers 32. The stringers in turn support cross-wise arranged floor joists 34. The joists in turn support flooring or sub-flooring 36 in the usual manner.

Figure 12:
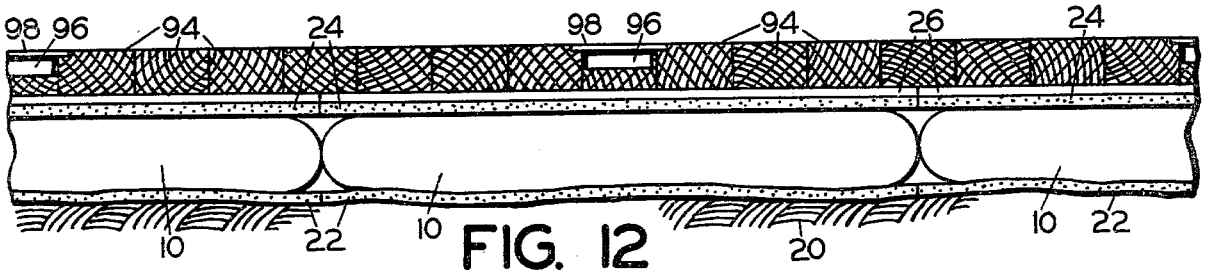
FIG. 12 is a fragmentary view in section illustrating a gas bag-supported deck of the invention.

FIG. 12 illustrates the concept of employing gas bags to support a heavy deck such as might be used as a warehouse floor, a loading platform, or the like.

In accordance with this concept, the underlying permafrost 20 is overlaid with a substantially continuous layer of insulation board sheets 22. Overlying the insulation board sheets are a plurality of gas bags 10 laid in close juxtaposition to each other as required to support a heavy load.

A layer of insulation board sheets 24 overlies the gas bags and a layer of plywood sheets 26 overlies the insulation board sheets. Heavy decking material, for example 4×10 timbers 94, are superimposed upon the plywood sheets and form the deck surface. Above each bag, a pocket 96 with cover plate 98 is provided in the deck for locating the pneumatic control unit by which the gas pressure in the bags is regulated.

Figure 7:
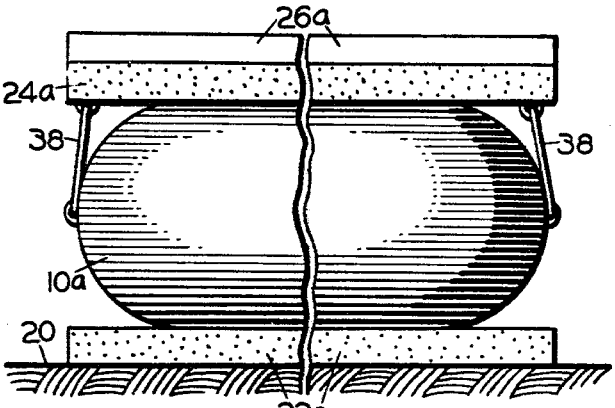
FIG. 7 is a foreshortened detail view in elevation of an alternate form of the invention.
Figure 8:
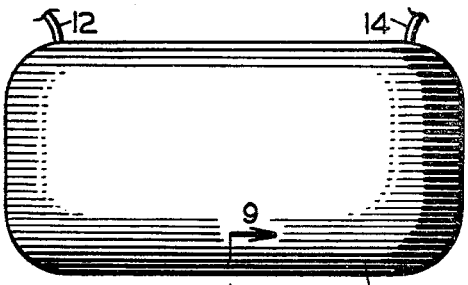
FIG. 8 is a schematic view in elevation of a pneumatic bag for use in supporting the foundation.

In the embodiment of FIG. 7, ground 20 supports an insulation board pad 22*a* which in turn supports bag 10*a*. The bag supports a composite pad comprising a sheet of insulation board 24*a* and an overlying sheet of plywood 26*a*. These provide the subflooring foundation of the assembly.

Lateral stability against wind load and other pressures to which the structure is subjected is imparted by means of ties 38 interconnecting the bags and the subflooring.

Figure 6:
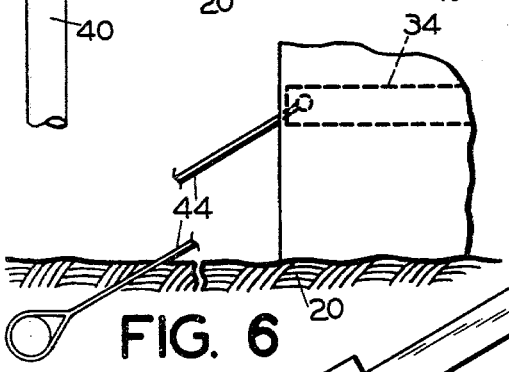
FIG. 6 is a fragmentary view in elevation illustrating a second type of lateral support for the building.

Alternate methods of imparting lateral stability are illustrated in FIGS. 4, 5 and 6.

In the embodiment of FIG. 4, lateral stability is imparted to the structure by means of piling 40 driven alongside the structure and in bearing engagement with the sides thereof at spaced intervals, there being, for example, on pile on each side of the structure.

In the embodiment of FIG. 5 the lateral support is provided by means of haunch buttresses 42, one end of each of which is connected to a foundation member, and the other end of which is driven into the ground.

In the embodiment of FIG. 6, lateral stability is imparted by means of cable tie-downs 44, one end of each of which is connected to a foundation member and the other to ground.

Figure 13:
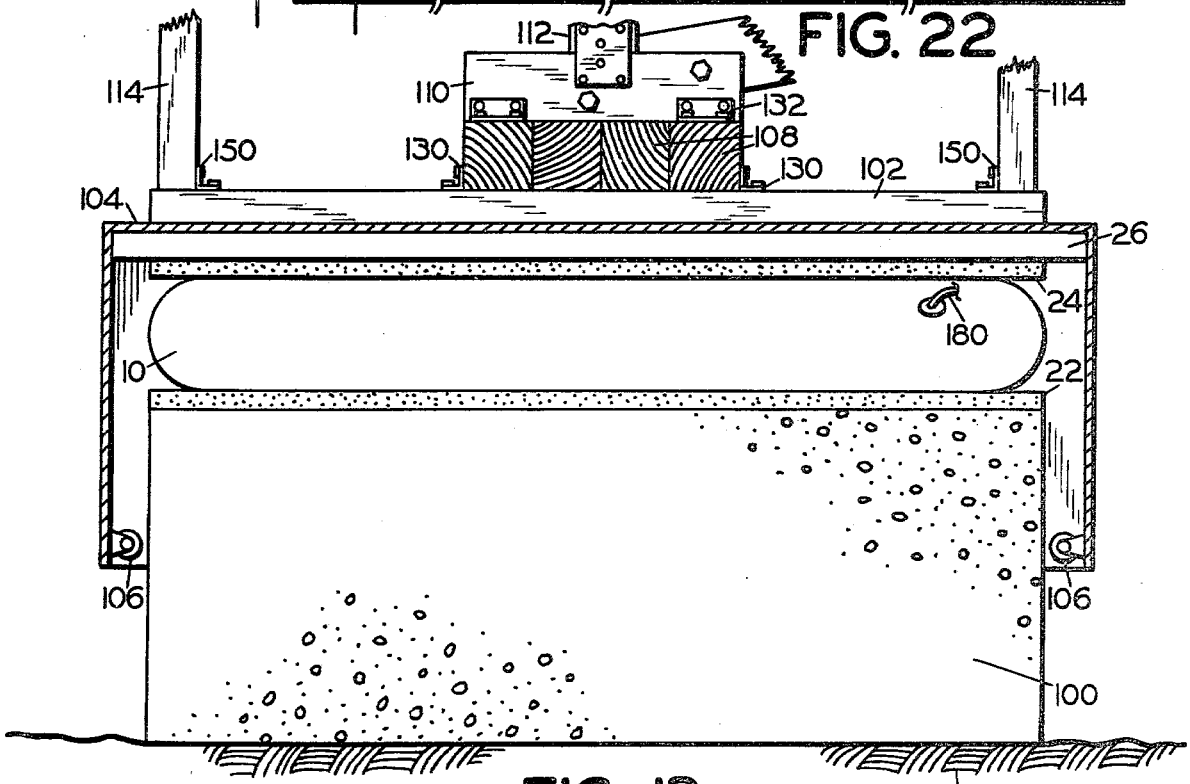
FIG. 13 is a view in side elevation of an alternate foundation unit incorporating a concrete block base.

In the embodiment of FIG. 13, lateral stability is provided by the use of a massive concrete support block and cooperating retainer.

In accordance with this embodiment, each bag 10 is supported on a massive rectangular concrete block 100 which rests on the tundra. Gas bag 10 is sandwiched between insulation board sheets 22, 24. A layer of plywood sheets 26 and planks 102 overlie insulation board sheets 24.

A stabilizer or retainer 104 in the shape of an inverted box made of heavy cast iron, lumber or steel is interleaved between plywood sheets 26 and planks 102.

The downwardly extending side walls of the stabilizer overlie in large measure the side walls of concrete block 100 from which they are spaced by a predetermined distance. Wheels or rollers 106 attached to the inner faces of the side walls of stabilizer 104 bear against the side walls of the concrete block, thus permitting free movement of the stabilizer up and down with expansion and contraction of bag 10 and movement of the ground.

Timbers 108 are supported centrally on planks 102. A single support timer 110 is arranged transversely and centrally of timbers 108. It supports a post 112 which in turn supports the floor joists of the building. Braces 114 further stabilize the structure.

In this construction, concrete block 100 provides sturdy support for the building. Stabilizer 104 provides lateral stability. It also serves as a shield or screen which protects gas bag 10 from damage such as might result from blows with sticks or implements, or the impact of missiles, either intentional or accidental.

The action of rollers 106 faciliates adjustment of the position of the stabilizer relative to the concrete block, thereby insuring proper alignment of the structural components even though the underlying ground should heave and sink with changing climatic conditions.

Figure 1:
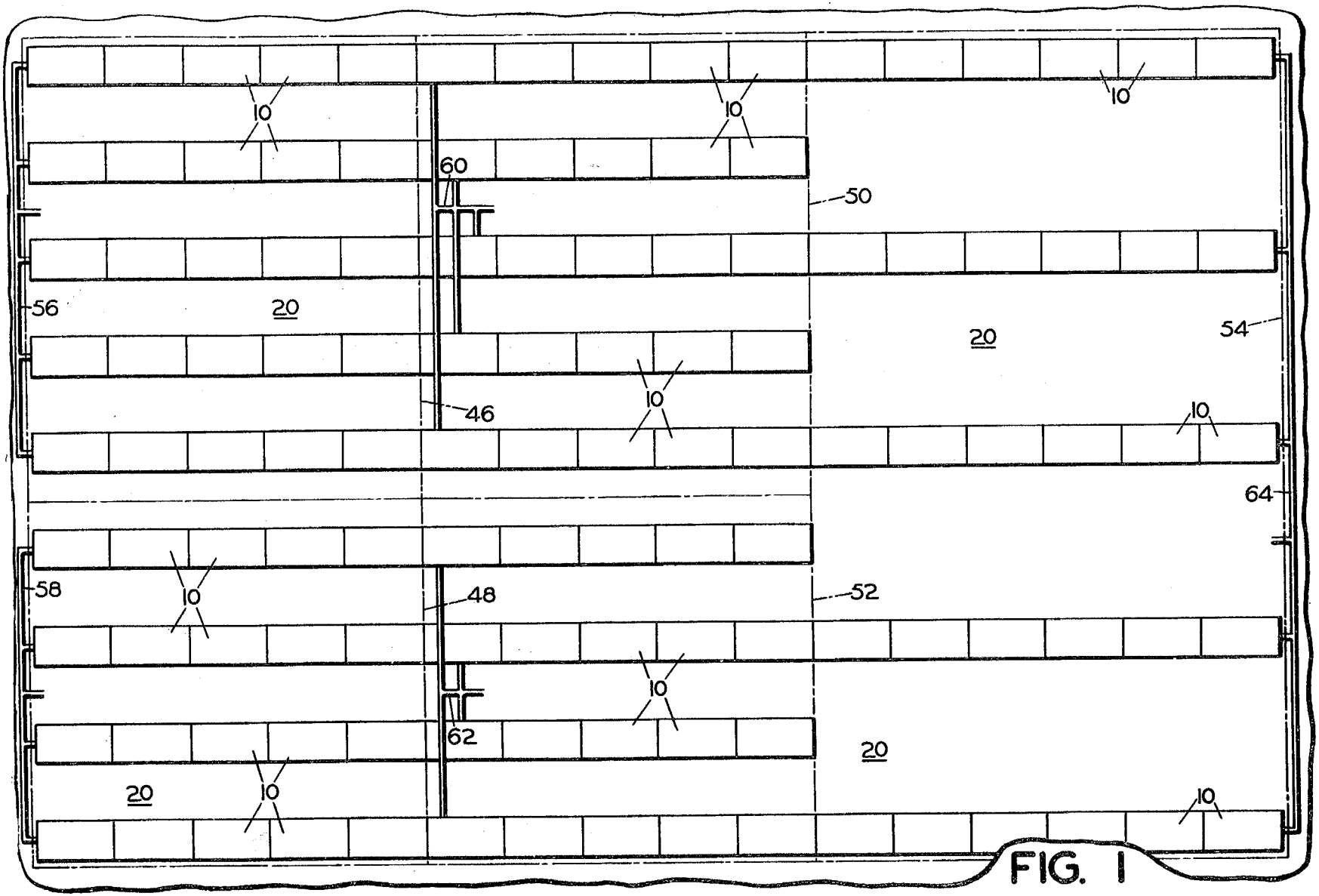
FIG. 1 is a schematic floor plan of the gas-bag supported structural foundation of my invention in one of its embodiments.

Although the concept of the invention may be practiced using but a single gas bag, it is preferred to use a plurality of bags in order to lend versatility to the installation and make it applicable to larger buildings various areas of which are variously loaded. In particular, it is preferred in the case of larger buildings to use groups or clusters of bags manifolded together. Such an installation is shown in FIG. 1.

In the installation of that figure, there are five different areas served by the air-support foundation of the invention. These are indicated generally at 46, 48, 50, 52 and 54 and indicate areas of different use and hence of different floor loading, both dead loading and live loading. Where the structure is a school house, such areas may comprise a gymnasium, an auditorium, a cafeteria, class rooms, and storage rooms.

These areas obviously have different support requirements since they are subjected to different loads at different times. Accordingly they are supported by a number of gas bags 10 calculated to meet the loading requirement. The bags of each area are arranged in series in groups, each group being connected to a common manifold, indicated respectively at 56, 58, 60, 62, 64.

Each manifold, and accordingly each group of bags, is supplied with a controlled amount of air or other gas as required to establish a level floor in the first instance and to maintain the floor level with time regardless of the load to which the floor is subjected.

To this end the bars are connected to a source of gas under pressure through conduit means including the manifold. The pressurized gas may be supplied from such sources as an air compressor, bottled compressed air, or bottled inert gasses such as nitrogen.

Figure 2:
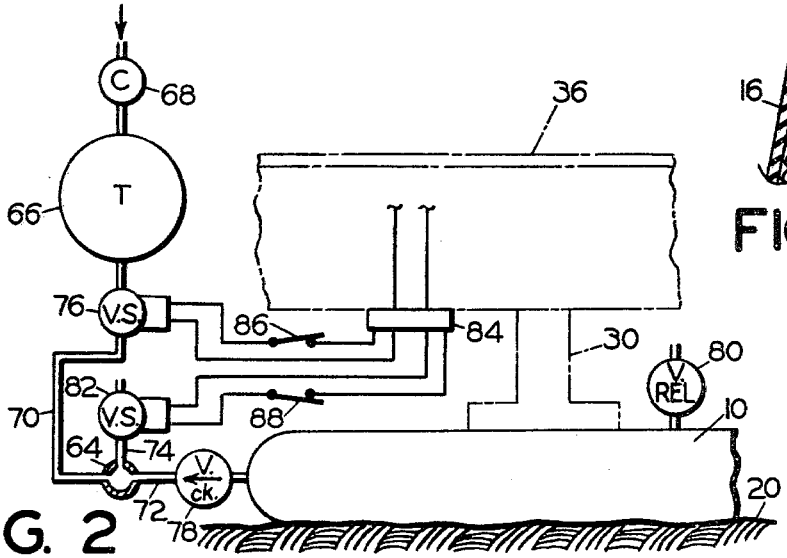
FIG. 2 is a schematic view of a control system for use therein.

Included in the conduit means are valve means responsive to changes in floor level and operative to direct the flow of gas to and from the bags as required to maintain the floor in a substantially level condition. One system for accomplishing this purpose is illustrated in FIG. 2.

Air under pressure is supplied to a pressurized air tank 66 by means of a compressor 68. The compressor preferably is equipped with dehumidifying means to remove moisture from the air which it processes.

One compressor-tank combination is provided for each of the groups of bags supplying the various floor areas 46, 48, 50, 52 and 54.

The air from the tank passes through a conduit 70 to one of the manifolds, such as manifold 64, supplying the group of bags 10 underlying area 54 of the building. The manifold in turn is connected through a conduit 72 to one of the groups of bags 10.

A third conduit 74 exhausts air from the manifold as occasion requires.

Valve means is incorporated in the conduit system to feed air to and exhaust air from the bags as required to maintain a level floor. Thus conduit 70 includes an infeed valve 76, conduit 72 includes a check valve 78, and conduit 74 contains an exhaust valve 82 venting to atmosphere. A relief or pop-off valve 80 communicates independently with bag 10.

Infeed valve 76 and exhaust valve 82 are controlled by a level-sensitive switch 84 located on the floor of the building, FIG. 4. It may be a mercury switch sensitive to changes in level of the support to which it is attached.

Valves 76, 82 also are subject to manual control by means of switches 86, 88 respectively.

In the erection of the structure, the foundation, flooring, and building superstructure all are constructed on bags 10 in a flat, un-inflated condition. After the construction of the building has been completed to the desired extent, the bags are inflated by activating compressor 68. Air from the associated tank 66 then is caused to flow through each manifold 64 into bags 10 by operating manual switch 86 which operates infeed valve 76. The bags of all of the groups of bags are inflated in this manner to an approximately level condition. Manual switch 88 may be employed during this procedure to exhaust air from a particular group of bags if it is desired to do so.

With the floor approximately level, level-sensitive switches 84 are energized. These operate valves 76, 82 to complete the levelling of the floor.

During the use of the structure, and as time goes on, the floor automatically adjusts to a level condition as required to accommodate changing loads and in particular to accommodate shifting of the ground through heaving, buckling, and sinking, occurring during the thawing and freezing of the permafrost. In the event of a large increase in pressure in any one of the bags, through some natural or artificial cause, the increased pressure may be bled off by operation of valve 82 with manual switch 88. In the alternative, in an emergency situation the excess pressure is relieved automatically by pressure-relief valve 80.

Should one of the bags become punctured or spring a major leak, the pressure in manifold 64 will drop. If the drop in pressure is so severe that it cannot be accommodated by means of infeed valve 76, check valves 78 operate to shut off the air in the non-leaking bags of the particular bag group concerned so that the level of the floor is maintained.

If it is desired to remove a defective bag, the check valves may be closed manually in the associated bags of the group containing the defective bag. The defective bag then is replaced with a new one and the check valves again set for automatic operation.

In the event of a flood, the bars serve as pontoons and assist in supporting the building.

It is to be noted particularly that the dunnage bags of the class recommended for use herein operate successfully at low pressure, i.e. pressures of from 0.1 pound to 10 pounds; typically about 6 pounds. This makes it possible to use low pressure conduits, valves and fittings with attendant economy and ease of installation.

Still another embodiment of the invention, which includes a pneumatically operated, rather than an electrically operated, control system, is illustrated in FIGS. 14–22 inclusive.

Figure 14:
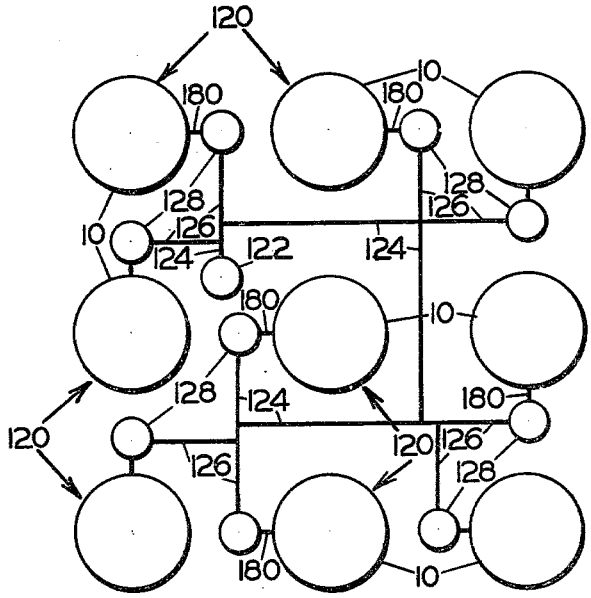
FIG. 14 is a schematic plan view of the gas-supported structural foundation of my invention with an alternate arrangement of foundation units.

FIG. 14 illustrates schematically an arrangement of gas bag foundation units, indicated generally at 120, which support a structure and which are supplied with gas (air) from a central source. This source may comprise an air compressor or bottled gas container 122. The source of gas communicates with a main conduit 124 which in turn communicates with the gas bag foundation units through branch lines 126, each including a pneumatic control valve assembly 128.

The gas bag foundation units 120 support the floor structure illustrated in FIG. 15. This structure comprises heavy beams or stringers 32 which may comprise glue lam beams. These in turn support floor joists 34 to which decking 36 is nailed.

The structure of each individual gas bag foundation unit 120, already discussed briefly in connection with FIG. 13, is illustrated in detail in FIGS. 16 and 17.

Sandwiched between insulation board sheets 22, 24 is gas bag 10. Heavy plywood, for example one inch plywood sheets 26, overlie insulation board sheets 24. Planks 102 are supported on the plywood sheets.

Short timbers 108 are secured centrally to planks 102 by means of angle irons 130. A single timber 110 is located transversely and centrally of timbers 108 and secured in position by means of angle irons 132. A post 112, which corresponds to post 30 of FIGS. 4 and 5, is supported vertically, centrally of timber 110. It supports stringer 32, and is fixed to both the stringer and timber 110 by means of anchor plates 134.

A wooden or metal skirt 136 surrounds and protects gas bag 10.

Pairs of diagonal braces 138, 140 and 142, 144, interconnect the foundation units through connectors 146, 148, and thus brace the structure.

Vertical braces 114 connected by angle irons 150, 152 stabilize stringer 32.

Pile 154, FIG. 16, or haunch buttress 156, FIG. 17, stabilize the entire building against lateral forces, in particular against strong winds.

The pneumatic control system by which the component bags of the foundation are inflated and deflated to maintain floor 36 in a level condition, irrespective of heaving, buckling and sinking of the ground, is illustrated in detail in FIGS. 18–22 respectively.

The pneumatic control system essentially comprises a plurality of float-controlled, three-position pneumatic valves 160 with associated conduits. One valve unit is provided for each gas bag 10. It is mounted adjacent its associated bag, as seen in FIG. 17. Or, as illustrated in FIG. 18, the valve unit is housed behind a wall 162 having an access opening 164 for service and adjustment.

Three of the valve units 160 are illustrated in FIG. 22. The center one is in a neutral, inactive position; the one to the left is in a working position in which it is filling its associated bag with gas to raise the level of the structure immediately above the bag; and the one to the right is in a working position in which it is deflating its associated bag as required to lower that portion of the building immediately above.

Each valve comprises a case 166 containing a floating piston or core 168. The core is spring-pressed by helical springs 170, 172 which normally center the core in the case in its intermediate, non-working position.

The core is provided with transverse bores 174, 176.

The conduits or piping associated with the pneumatic valves include first conduit 126 communicating with a source of air or other gas under pressure; a second conduit 180 leading to the associated pneumatic bag; and a third conduit or port 182 vented to atmosphere.

Also provided are a conduit 184 interconnecting the gas pressure line with the top of the valve and a conduit 186 interconnecting it with the bottom of the valve. Bypass lines 188 and 190 each include a flow control valve 192, 194, respectively. These valves include minute orifices which restrict, but do not preclude, the flow of gas in the arrow-indicated direction, as will appear hereinafter.

To protect the valves and their associated conduits and to insure their reliable performance over long periods of time, it is preferred to encase them in plastic manifold blocks indicated by the dashed outlines of FIG. 22.

All of the valves are operated by means of a float control, the construction of which is also seen in FIG. 22.

A reservoir 196 is mounted in a central location. It contains a non-freezable liquid such as alcohol, or water with anti-freeze. The reservoir is provided with a discharge pipe 198 which feeds the liquid to a manifold 200.

The manifold comprises a length of flexible plastic or rubber hose which connects the reservoir with the three float control valves indicated generally at 202.

Each of the float control valves includes a tank 204 adapted to be filled with liquid to the dashed line level. It will be apparent that this level will be the same in all of tanks 204 and will be determined by the level of the liquid in reservoir 196.

Tank 204 contains a float 206 which is guided by a central post 208, FIGS. 18 and 19.

Float 206 mounts a pair of standards 210, 212. Each standard has clamped thereto an associated, laterally extending contact finger 214, 216 respectively.

Standards 210, 212 are of different height, FIG. 19. Standard 210, the taller, makes the desired correction in bag inflation when the underlying ground subsides. Standard 212, the shorter, makes the desired correction in bag deflation when the underlying ground rises.

Operatively associated with each of the standards and their operating fingers 214, 216 are air exhaust valves 218, 220 respectively. The arrangement is such that when exhaust valve 218 is contacted by finger 214, it exhausts air from conduit 184. However, when exhaust valve 220 is contacted by finger 216, it exhausts air from conduit 186.

The construction of exhaust valves 218, 220 is identical (conventional) and is shown in detail in FIG. 21.

A fitting 222 is coupled at one end to conduit 184 and at the other end to a valve body 224. The latter mounts to a support, such as the wall of case 204, where it is secured by a nut 226.

Valve body 224 has a port or orifice 228 forming a valve seat. It houses a helical spring 230 and a spool-shaped valve stem 232. The latter seats in orifice 228 and extends outwardly therefrom. At its extremity it mounts a contact member 234. This is adapted and positioned for contact with finger 214 which actuates the valve.

The operation of the embodiment of the invention illustrated in FIGS. 18–22 is as follows:

With a plurality of gas bag foundation units underlying the building in a pattern such as is illustrated in FIGS. 14 and 15, the fluid in reservoir 196, FIG. 22, and the associated tanks 204 is at the same dashed line level, i.e. at a level corresponding to the level condition of the building, in which the three position pneumatic valves 160 are in their neutral or intermediate positions, as illustrated in FIG. 19 and in the central position of FIG. 22.

If with the passage of time the ground should subside under part of the building i.e. that controlled by the left hand valve, FIG. 22, tank 204 and its associated elements including valve 218 will drop, but the level of liquid in the tank will remain the same, since it is controlled by the level of liquid in central reservoir 196.

As valve 218 drops with the tank, it will contact finger 214 on float 206, which remains stationary relative to the valve. This will actuate the valve and exhaust the air from line 184 leading to the top of three-position valve 160. Accordingly it also will exhaust the air from the chamber above valve core 168.

Thereupon the lower helical spring 172 will push the core upwardly. Cross channel 176 then will register with pipes 126 and 180. This will interconnect the source of gas under pressure, to which pipe 126 is coupled, with the bag, to which pipe 180 is coupled, thereby inflating the bag.

As the bag inflates, it will elevate the building and raise tank 204 until it reaches the central position of FIG. 22. In this position, air release valve 218 is no longer actuated and air again is supplied to the upper end of three-position valve 160, restoring it to its intermediate position.

During the foregoing action, flow control valve 192 restricts the flow of air from pipe 126 to pipe 184 when air release valve 218 is open to the atmosphere and vented. However, when the latter valve is closed, air under pressure will find its way through the orifice of the valve into the upper chamber behind core 168.

The converse action occurs when through heaving of the ground the building rises. In this event, tank 204 and associated air release valve 220 will be lifted, but the float 206 contained in the tank will remain at the same level. This will have the effect of contacting finger 216 with the actuator 234, FIG. 21, of air release valve 220. In turn, this will exhaust the air from the chamber below core 168 of the three-position valve so that the core assumes the position illustrated in the right hand valve of FIG. 22.

In this position of the valve core, air exhaust line 182 is connected through bore 174 and pipe 180 to the air bag so that the air bag deflates. Deflation continues until the building again is level, when the three-position valve and its float valve actuator return to their neutral positions.

Having thus described my invention in preferred embodiment, I claim:

1. In combination with a building constructed on terrain subject to shifting due to thawing and freezing, a foundation for supporting the building comprising
   (a) a plurality of inflatable bag members each including at least one gas opening, said bag members being adapted for positioning on the terrain;
   (b) support means mounted on the upper surface of said bag members; and
   (c) self-leveling means for maintaining said support means in a substantially horizontal position, said self-leveling means including
      (1) compressed gas supply means;
      (2) supply and exhaust conduit means connecting each of said bags with said gas supply means and with exhaust, respectively;
      (3) first valve means (76) connected in said supply conduit means and second valve means (82) connected in said exhaust conduit means, said valve means controlling the degree of inflation of said bags, respectively; and
      (4) level-responsive means responsive to shifting of said support means resulting from thawing or freezing of the terrain, said level-responsive means being mounted on said support means for selectively operating said valve means to maintain said support means in a level condition.

2. Apparatus as defined in claim 1, wherein said bag members comprise heavy duty flexible rubber bags.

3. Apparatus as defined in claim 2, wherein said valve means further comprises check valve means (78) operable upon rupture of one of said bags to check the degree of inflation of the remaining bags.

4. Apparatus as defined in claim 3, wherein said valve means further comprises pressure relief valve means (80) for decreasing the degree of inflation of said bags, respectively, upon overloading of said bags.

5. Apparatus as defined in claim 1, wherein said bags are arranged in a plurality of groups, each of said groups including manifold means connected in said conduit means for controlling the degree of inflation of said bags within said groups, respectively.

6. Apparatus as defined in claim 1, wherein said valve means comprises electric valve means and said level-responsive means comprises a level-sensitive electric switch (84), and further including electric control circuit means responsive to said level-sensitive electric switch for controlling said electric valve means.

7. In combination with a building constructed on terrain subject to shifting due to thawing and freezing, a foundation for supporting the building, comprising
   (a) a plurality of inflatable bag members each including at least one gas opening, said bag members being adapted for positioning on the terrain;
   (b) support means mounted on the upper surface of said bag members; and
   (c) self-leveling means for maintaining said support means in a substantially horizontal position, said self-leveling means including
      (1) compressed gas supply means;
      (2) supply and exhaust conduit means connecting each of said bags with said gas supply means and with exhaust, respectively;

(3) pneumatically-displaceable valve means connected in said conduit means for controlling the degree of inflation of said bags, respectively, said valve means being displaceable between a bag-filling position connecting said bags with said gas supply means, a neutral position, and a bag-venting position connecting said bags with exhaust; and (4) pneumatic level-responsive means responsive to shifting of said support means resulting from thawing or freezing of the terrain, said level-responsive means being mounted on said support means for selectively displacing said valve means to maintain said support means in a level condition.

8. Apparatus as defined in claim 7, wherein said level responsive means comprises (a) float actuator means (206); and (b) first gas pressure line means (184) connecting said float actuator means with one end of said valve means, and second gas pressure line means (186) connecting said float actuator means with the other end of said valve means, said first and second gas pressure line means being responsive to said float actuator means for displacing said valve means between bag-filling and bag-venting positions, respectively.

* * * * *